US005407253A

United States Patent [19]

Page et al.

[11] Patent Number: 5,407,253

[45] Date of Patent: Apr. 18, 1995

[54] WATER SPRAY VENTILATOR SYSTEM FOR CONTINUOUS MINING MACHINES

[75] Inventors: Steven J. Page; Thomas Mal, both of Pittsburgh, Pa.

[73] Assignee: The United States of America as represented by the Secretary of the Interior, Washington, D.C.

[21] Appl. No.: 268,538

[22] Filed: Jul. 6, 1994

[51] Int. Cl.[6] ..... E21C 35/22

[52] U.S. Cl. ..... 299/12; 299/81

[58] Field of Search ..... 299/12, 64, 81

[56] References Cited

U.S. PATENT DOCUMENTS 4,157,204 6/1979 Kissell et al. ..... 299/12 X 4,632,462 12/1986 Poling ..... 299/12

OTHER PUBLICATIONS

*Mining Congress Journal,* "Water Spray Induced Free Ventilation", Harley Piles, Sep. 1979, pp. 27–30.

*Primary Examiner*—David J. Bagnell

*Attorney, Agent, or Firm*—E. Philip Koltos

[57] ABSTRACT

The invention relates to a water spray ventilator system mounted on a continuous mining machine to streamline airflow and provide effective face ventilation of both respirable dust and methane in underground coal mines. This system has two side spray nozzles mounted one on each side of the mining machine and six spray nozzles disposed on a manifold mounted to the underside of the machine boom. The six spray nozzles are angularly and laterally oriented on the manifold so as to provide non-overlapping spray patterns along the length of the cutter drum.

9 Claims, 5 Drawing Sheets

WATER SPRAY VENTILATOR SYSTEM FOR CONTINUOUS MINING MACHINES

FIELD OF THE INVENTION

The invention relates to a spray system to be used on continuous mining machines for providing face ventilation of both respirable dust and methane gas in underground coal mines.

BACKGROUND OF THE INVENTION

Water sprays have traditionally been used on continuous mining machines for several reasons. These include dust suppression, bit lubrication, and reduction of frictional ignition. These water sprays have always been located along the top edge of the miner boom, and sometimes underneath and on the sides of the boom. The top-mounted sprays were located in such a position solely for convenience of accessibility and maintenance. Underboom nozzles have not been practical because of either or both of the following: 1) underboom nozzles required significantly more maintenance due to the harsh conditions under the boom and are readily damaged; 2) by law, the machine boom must be blocked up physically and independently of the machine hydraulics in order to access the nozzles. This is a more labor-intensive procedure and, in actual mining, is unacceptable.

As has been proven by previous research, these top-mounted water sprays can frequently create more dust problems than they solve by creating a phenomenon termed "rollback". This rollback is most severe at marginal airflows in the mine entry .and with conventional cone-type water sprays operating at pressures as low as 40 psi.

In longer mine entries, this rollback usually occurs on the off-curtain side (side opposite the exhaust ventilation curtain). This is due to the lower air velocity on the off-curtain side created by the ventilation air short-circuiting diagonally across the continuous mining machine to the curtain. In short mine entries (as in turning a crosscut), the opposite will usually occur. This is due to the ventilation air "hugging" the off-curtain rib as it tries to turn into the entry. Thus, rollback can also be substantial in the area between the continuous mining machine and the curtain.

FIG. 1 shows a typical conventional top mounted water spray manifold (10) positioned behind the drum (12) on a continuous mining machine and supplied from the factory mounted on the machine. Several disadvantages are apparent as follows: 1) There are nozzles evenly distributed across the boom. The drawback to this arrangement is that when the machine is up against either rib, the sprays on the ends are creating significant turbulence on either face-rib corner. 2) There is a significant amount of overlap between spray patterns of nozzles, in particular adjacent nozzles. While this may be ideal from a coal-wetting point of view, it is quite contrary to the notion of trying to streamline the airflow at the cutting face. 3) All of the nozzles are identical and oriented perpendicular to the face. This suffers from the fact that the airflow that a given nozzle "sees" is not the same as the airflow "seen" by the adjacent nozzles.

For more than two decades, researchers have labored to develop practical, functional water spray systems for continuous mining machines. However, the result is usually that a spray system which works well for dust control in one machine position, e.g., the box cut, does not perform well at other positions such as the slab cut. One of the more successful water spray systems was developed by the United States Bureau of Mines and is known as the anti-rollback system. This system also employs top-mounted water sprays to apply virtually all of the water to the cutter drum. The design of this anti-rollback system, however, uses flat-fan sprays and orients the nozzles in such a way as to minimize the distance travelled by the water spray before impingement. This technique serves to minimize interaction time between the water spray and the ventilation air. It is noted that this system was designed primarily to reduce rollback-created operator dust exposure, not to entirely eliminate it. As a result, this system has reduced operator exposure to miner-generated dust by only 40 percent.

Another deficiency in previous water spray systems is that a water spray system designed for improved dust control usually is not effective in removing hazardous methane from the face area. Conversely, a spray system designed for efficient methane removal, such as the U.S. Bureau of Mines-developed Sprayfan system, would create significant dust rollback unless the spray parameters are carefully balanced with the face ventilation conditions. In actual practice this criteria is usually not met.

SUMMARY OF THE INVENTION

The invention relates to a water spray ventilator system for continuous mining machines having a number of nozzles spaced along the length of a manifold mounted on the underside of a mining machine boom. These nozzles are positioned at progressively increasing angles relative to the longitudinal axis of the manifold, providing a non-overlapping pattern of water spray. Additionally, the water spray ventilator system is provided with at least one nozzle on each side of a continuous mining machine and an optional manifold mounting track that allows the nozzle-carrying manifold to slide on or off for routine maintenance.

The invention effectively controls the level of respirable dust and methane simultaneously, regardless of the mining machine's position at the working face, and overcomes the above-mentioned drawbacks and disadvantages of the prior art.

It is an object of the invention to provide a water spray ventilator system for effective face ventilation of both respirable dust and methane gas.

Another object of the invention is to provide nozzles arranged in a manifold for mounting under the boom of a continuous mining machine to prevent rollback and to improve face visibility.

A further object of the invention is to provide a spray manifold mounting arrangement that eliminates the need for physically blocking up the machine boom for periodic maintenance.

Still another object of the invention is to provide an arrangement of angled nozzles on the spray manifold with non-uniform spacing between nozzles to minimize spray pattern overlap.

Yet another object of the invention is to reduce frictional ignition caused by the cutting bits on the drum of a continuous mining machine.

DETAILED DESCRIPTION OF THE INVENTION

The water spray ventilator system of the invention comprises a plurality of nozzles mounted in various ways on the under side of a continuous mining machine boom to provide a pattern of water spray that is effective in face ventilation of both respirable dust and methane gas in underground coal mines. This water spray ventilator system overcomes the drawbacks and difficulties encountered with conventional water spray ventilator systems by 1) reducing rollback, 2) eliminating the need to physically block the boom of a continuous mining machine for maintenance of the nozzles, 3) reducing the turbulence created by sprays on the ends in a face-rib corner, 4) eliminating or reducing the overlap between water spray patterns of adjacent nozzles to streamline the airflow, 5) functioning effectively in various machine positions, i.e., for box cut, slab cut, etc., 6) improving face visibility, 7) improving bit lubrication and reducing frictional ignition, and 8) being effective in not only removing respirable dust but also hazardous methane from the face area.

Dust rollback occurs in conventional water spray ventilator systems due to an unbalanced energy condition between the energy delivered by the water sprays to the air (and dust) and the primary ventilation, whose energy is directly proportional to the square of the Mean Entry Air Velocity (MEV). The result of this unbalanced condition is a significant increase in turbulence at the cutting face. The invention solves this problem by using a systems approach, i.e. by considering how the water sprays from each nozzle individually moves air and how this in turn relates to the other nozzles and the ventilation air.

Figure 2:
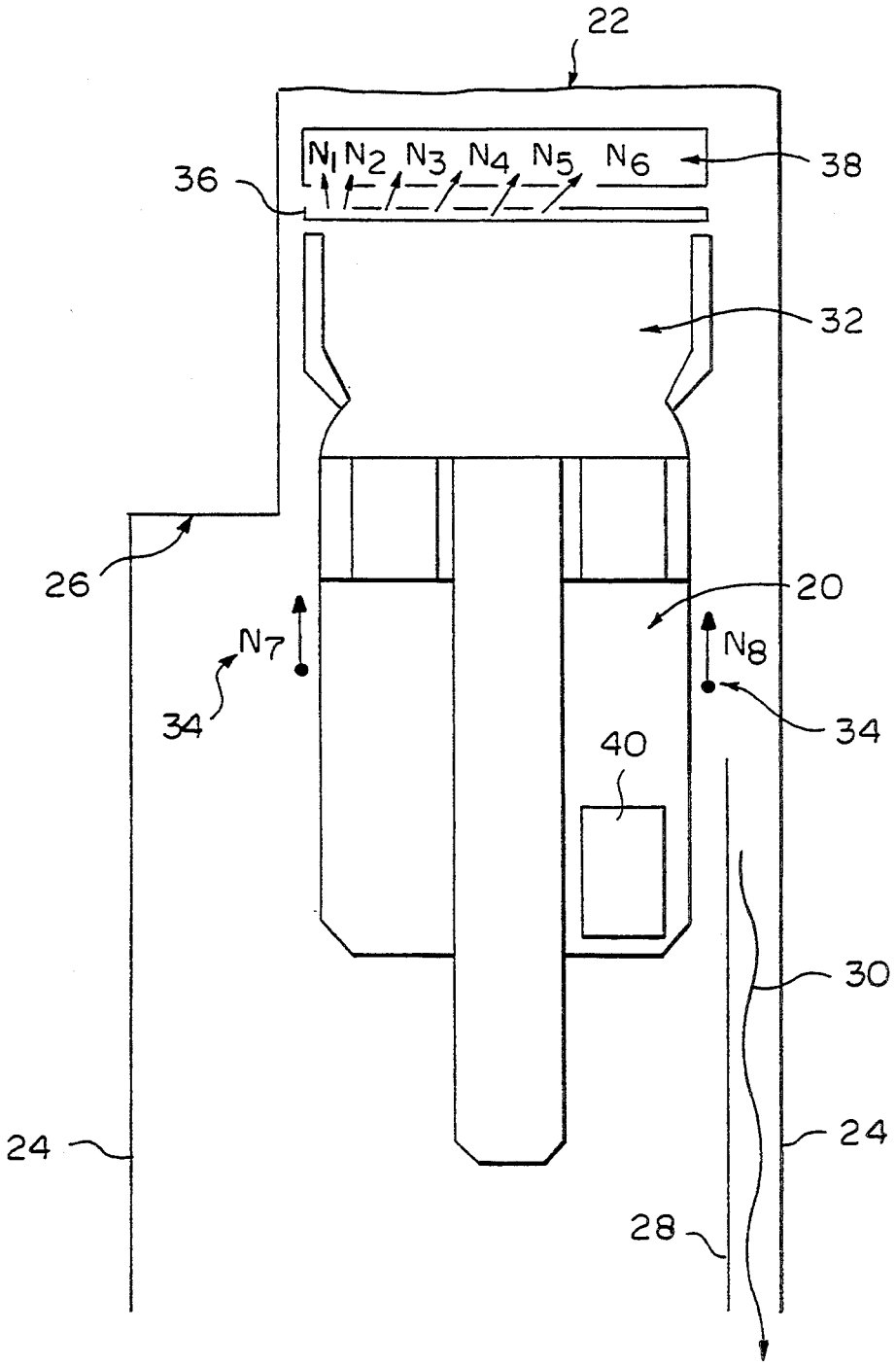
FIG. 2 is a drawing of a continuous mining machine during operation in a mine entry showing the positioning of the underboom spray manifold and nozzles according to the invention.

The water spray system of the invention is designed to operate in a manner where the water sprays from the nozzles do not counteract the airflow but rather streamlines it for effective face ventilation. This system may be appropriately called a "tuned" spray system based on its principle of operation for streamlining the airflow from the face. FIG. 2 shows an example of the water spray ventilator system mounted on a continuous mining machine (20) and operating in a mine entry at a face box cut (22) with left and right ribs (24) and a slab face (26). The continuous mining machine with cab (40) in FIG. 2 is depicted as operating with its exhaust ventilation curtain (28) on the right rib side to channel exhaust airflow (30) away from the cutting face with the left rib side being the off-curtain side. The water spray ventilator system itself is arranged as a plurality of water spray nozzles ($N_1$–$N_8$) with one spray nozzle mounted on each side of the continuous mining machine (side spray nozzles $N_7$, $N_8$ (34)) and six spray nozzles ($N_1$–$N_6$) mounted to a manifold (36) on the underside of the boom (32) and behind the drum (38) of the continuous mining machine. Continuous mining machines are not to be interpreted as being limited to the type shown in FIG. 2 but is intended to also cover long wall shearer machines as a form of continuous mining machine.

Thus, one embodiment of the invention is a tuned water spray system as exemplified in FIG. 2 using a total of only eight nozzles with six nozzles attached to an underboom manifold mounted on the under side of the machine boom and two additional side nozzles located on the sides of the continuous mining machine, one side nozzle per side. As represented in FIG. 2, the underboom manifold carrying the spray nozzles are located under the left side of the boom when the continuous mining machine operates with the exhaust ventilation curtain on the right rib side and, consequently, spray nozzles are absent from under the right side of the boom. The converse holds when the continuous mining machine operates with the exhaust ventilation curtain on the left rib side and the spray nozzles are all located under the right side of the boom. As a result of arranging the spray nozzles under the side of the boom opposite from the exhaust ventilation curtain, there are no immediate nozzles on the exhaust rib side of the boom that can create unnecessary turbulence in that face-rib corner.

Figure 3:
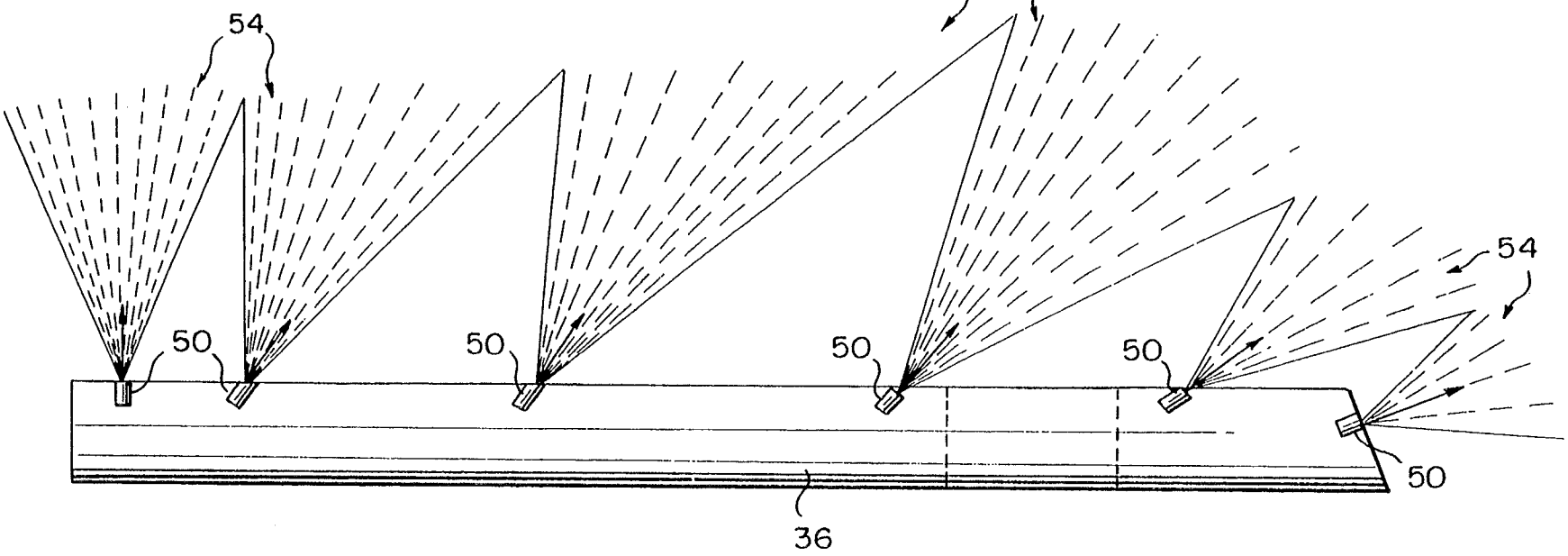
FIG. 3 is a schematic top view of the underboom spray manifold carrying the nozzles of FIG. 2.

A feature of the invention common to all embodiments of the invention is that the spray nozzles are positioned on the underboom manifold, from the end closest to the exhaust ventilation curtain side to the off-curtain side, at progressively increasing angles so that the spray patterns just converge at the drum in front of the boom in a non-overlapping pattern and the water spray tends to push air and other gases in the direction of the return (exhaust ventilation). All manifold spray nozzles have their longitudinal axes in the same plane and the spray nozzle angle is measured from the longitudinal axis of the nozzle to the longitudinal axis of the manifold. This arrangement of nozzles significantly reduces spray interaction and turbulence and, hence, rollback. FIG. 3 shows a schematic top view of the spray nozzles (50) mounted on a manifold (36) at progressively increasing angles from right to left. The directions of the non-overlapping water sprays (54) are indicated by the arrows emanating from the spray nozzles (50).

In order to achieve the non-overlapping spray patterns or at least minimize the spray pattern overlap at the drum, each nozzle is positioned angularly and laterally along the longitudinal axis of the underboom manifold. Consequently, one reason for positioning the spray nozzles at different angles and with non-uniform lateral spacing between spray nozzles is the goal of developing a non-overlapping spray pattern and, hence, of reducing turbulence and rollback.

A further feature of the water spray ventilator system is that the spray nozzles are not all the same size and thus do not all provide the same amount of water flow (water flowrate). In general, the spray nozzles increase in flowrates along the manifold in the direction of progressively decreasing spray nozzle angles, i.e. from left to right along the underboom manifold in FIGS. 2 and 3. This feature of the water spray ventilator system takes into consideration that each spray nozzle adds some amount of energy to the airflow and provides some degree of turning of the airflow. Consequently, the spray nozzle on one end of the underboom manifold with the lowest angle relative to the longitudinal axis of the manifold would provide more energy than its adjacent spray nozzle and should provide more turning of the airflow. As shown in FIG. 2, if the spray nozzles are designated $$N_1, N_2, N_3, N_4, N_5, N_6$$

from left to right along the underboom manifold, then the water flow relationship would be $$Q_1<Q_2<Q_3<Q_4<Q_5<Q_6.$$

However, for practical mining applications, the water flow relationship $$Q_1<Q_2=Q_3=Q_4=Q_5=Q_6$$

can be used with satisfactory results.

The specific spray nozzle selection and the angular and lateral positioning of the spray nozzles on the underboom manifold and on each side of the continuous mining machine is dependent on the total water flowrate requirements specified by mining law in the Dust and Ventilation Plan for each continuous mining machine approved by the Mine Safety and Health Administration. This total water flowrate requirement serves as the basis for selecting a combination of spray nozzles that would provide the required total water flowrate at a given water pressure. The angular and lateral positioning of the spray nozzles along the underboom manifold can then be determined so as to achieve non-overlapping spray patterns or at least spray patterns with minimized spray overlap at the drum. The pressure, flowrate, and spray nozzle angles of the two spray nozzles closest (having the lowest angle relative to the longitudinal axis of the manifold) to the manifold end located near the middle of the boom, must be sufficient to provide water spray coverage of one side or half of the drum (the same side where spray nozzles are absent under the boom) on the exhaust curtain side. Thus, the water spray ventilator system provides for variations in the spray nozzle selection, welter flowrate and angular and lateral orientation of spray nozzles which can readily be ascertained for each continuous mining machine.

An example of the spray nozzle parameters for the water spray ventilator system of the invention used on a continuous mining machine operating as shown in FIG. 2 is presented in Table 1 below.

TABLE 1

| NOZZLE | TYPE | FLOWRATE gal/min | PRESSURE | ORIENTATION degrees |
|---|---|---|---|---|
| $N_1$ | HU40-20 | 3.2 | 100 | 90 |
| $N_2$ | HU40-30 | 4.7 | 100 | 72 |
| $N_3$ | HU40-30 | 4.7 | 100 | 63 |
| $N_4$ | HU40-30 | 4.7 | 100 | 53 |
| $N_5$ | HU40-30 | 4.7 | 100 | 40 |
| $N_6$ | HU40-30 | 4.7 | 100 | 20 |
| $N_7$ | HU40-10 | 1.6 | 100 | 0–5 |
| $N_8$ | HU40-10 | 1.6 | 100 | 0–5 |

In the water spray ventilator system of the invention, large orifice flat-fan nozzles are preferred, as opposed to hollow or solid cone type nozzles traditionally used in conventional spray systems. Other suitable nozzles may be used that provides the same spray coverage and functions satisfactorily in this system. Generally, a total of eight spray nozzles in the water spray ventilator system of the invention is preferable with two side spray nozzles and six spray nozzles disposed on the underside of the machine boom. This makes for a system with fewer nozzles than the twenty to thirty nozzles required by conventional spray systems. Not only are the large orifice flat-fan spray nozzles able to provide the total water flowrate required with fewer nozzles than a conventional spray system, but are also able to provide the maximum amount of water directly to the cutter drum. Moreover, these large orifice spray nozzles are much less susceptible to clogging than the conventional types of spray nozzles. In fact, actual operation of this water spray ventilation system on a continuous mining machine in an underground mine has not resulted in any spray nozzle malfunction due to clogging and, therefore, has not required any maintenance of the nozzles. This no maintenance, or at the very least, low maintenance water spray ventilator system solves a clogging and maintenance problem that represents a major impediment and source of resistance to the use of underboom mounted nozzles.

The two side spray nozzles $N_7$ and $N_8$ (34) as shown in FIG. 2 are also flat fan type nozzles. However, unlike the flat fan spray patterns of the underboom mounted spray nozzles which are oriented in a more or less horizontal plane, the flat fan spray pattern of the side spray nozzles are oriented in a vertical plane. The purpose of these nozzles is to provide forward movement of air along the sides of the continuous mining machine to prevent dust rollback from occurring along the floor. This is especially critical when the machine is against the exhaust ventilation curtain or a rib of the mine entry. These side nozzles are angled between 0 and 5 degrees relative to the longitudinal axis of the continuous mining machine.

Figure 4:
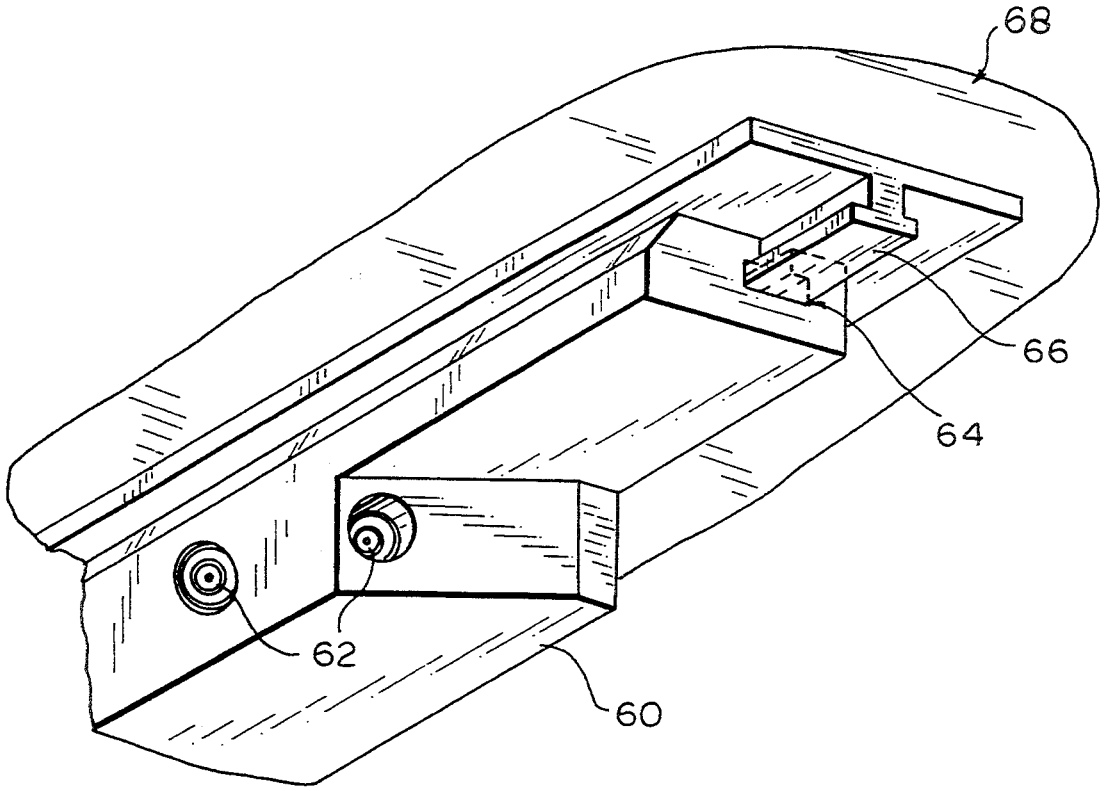
FIG. 4 is a drawing showing the mounting of the nozzle carrying spray manifold on a manifold mounting track underneath the mining machine boom according to the invention.

The performance of the water spray ventilator system in reducing dust exposure and methane removal is not dependent upon the form of the manifold or the mounting arrangement for the manifold. The manifold may be mounted on the underside of the boom as a single piece as indicated by the solid lines in FIG. 3 or may be mounted as two or more sections as indicated by the dotted lines in FIG. 3. The manifold may be directly secured to the underside of the boom, such as by welding, or may be slidably mounted on a track that is secured to the underside of the boom. As shown in FIG. 4, the entire underboom manifold (60) carrying recessed spray nozzles (62) can be fabricated in such a way so as to form a Tee-slot (64) which can be attached to and capable of sliding on a Tee-track mounting (66). The Tee-track mounting (66) can be secured to underside of the boom (68) by any suitable means such as being directly welded to the underside of the boom or bolted to a mounting plate welded to the underside of the boom. Although this alternative Tee-track mounting arrangement of the nozzle manifold can eliminate the need for physically blocking the machine boom for any required maintenance, the use of large orifice flat fan type spray nozzles recessed in the manifold for protection seem to require little or no maintenance under normal operating conditions in a mine.

One common type of continuous mining machine uses a ripper chain which occupies the middle third of the drum for driving the cutting drum. Thus, in another embodiment of the water spray ventilator system for use on continuous mining machines of this type, the underboom manifold would be divided into two longitudinal sections by the position of the ripper chain, with one section on one side of the ripper chain having between three to five spray nozzles and the second section on the other side of the ripper chain having the remaining nozzles (the dotted lines in FIG. 3 indicate that the manifold can be divided into sections).

Figure 1:
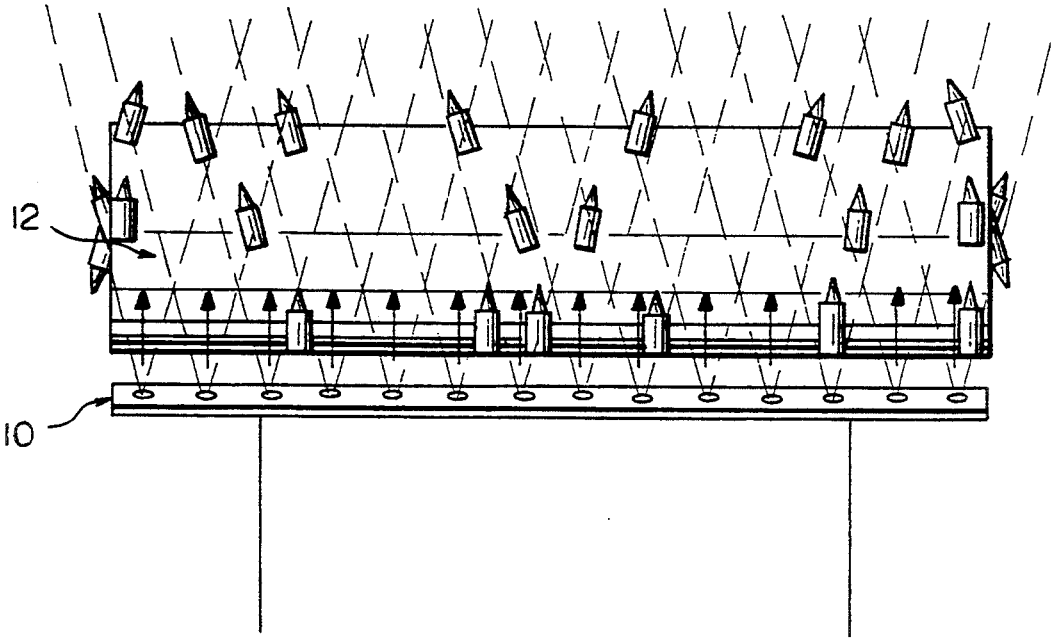
FIG. 1 PRIOR ART
FIG. 1 is a drawing of a conventional top mounted spray manifold positioned behind a drum.
Figure 5:
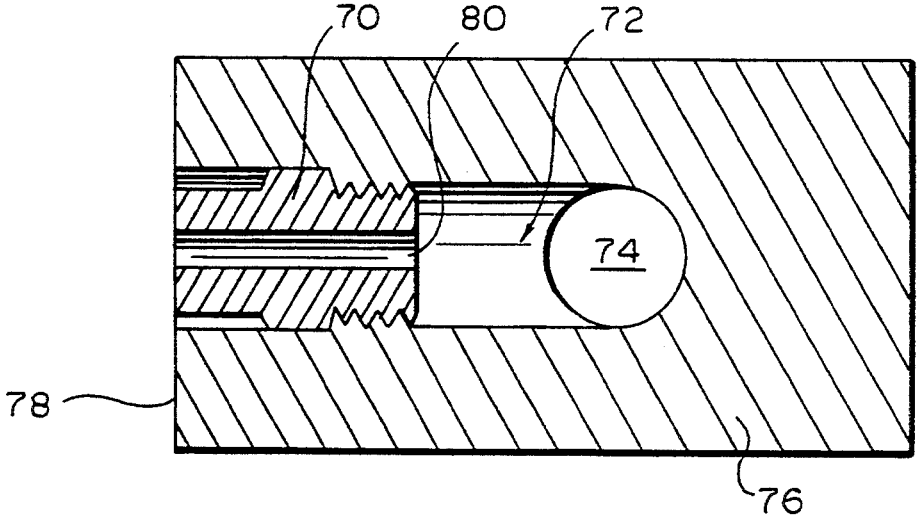
FIG. 5 is a cross-sectional view of the underboom spray manifold of FIGS. 3 and 6.

The manifold can be suitably fabricated from a variety of materials and can also be formed in various ways. For instance, the manifold may be made from a rectangular metal bar stock with holes drilled for water flow and threaded to accept spray nozzles in a recessed manner along the length of the manifold. A cross-sectional end view of a manifold arrangement is shown in FIG. 5 where a spray nozzle (70) having a large orifice (80) is threaded into a hole (72) and communicating with a water conduit (74) in the manifold (76) so as to be recessed from the front surface of the manifold (78). The manifold can also be fabricated from rectangular metal duct with the nozzles mounted in one wall of the duct and provided with a shield for protection. As another of the various ways a manifold and nozzle assembly can be fabricated and formed, the manifold can be fabricated from schedule 40 or schedule 80 pipe with the spray nozzles mounted co-linearly in the pipe wall. In cases where the spray nozzles are not entirely recessed in the manifold, suitable shielding may be needed as protection for the spray nozzles.

Figure 6:
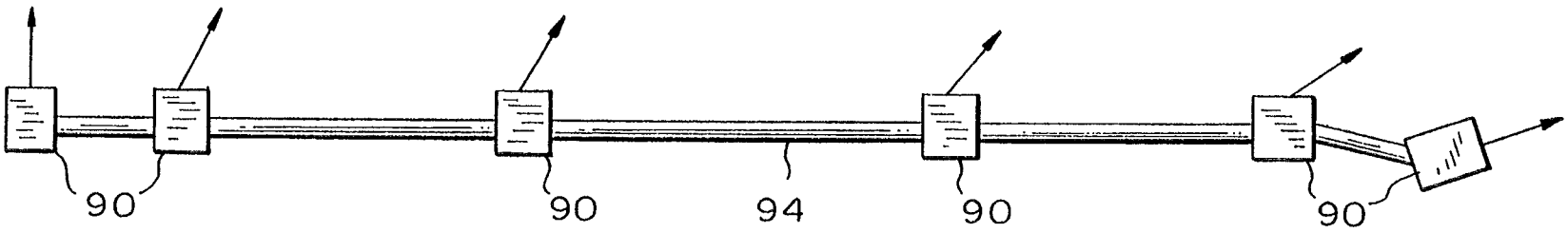
FIG. 6 is a schematic top view of another embodiment of the underboom spray manifold according to the invention.

The manifold can also be comprised of a series of individual blocks or sections of the manifold, discontinuously secured to the underside of the boom, with each individual block or section accepting a spray nozzle for mounting. This embodiment of a manifold arrangement is shown in a top view (FIG. 6) where the individual blocks (90) carrying spray nozzles oriented in the direction of the arrows is arranged in series and connected by a water conduit (94). Thus, the manifold can be in one single section, two or more sections or as individual blocks for accepting individual spray nozzles.

Another embodiment of the water spray ventilator system has a total of fourteen spray nozzles with twelve spray nozzles mounted on the underside of the boom and two spray nozzles mounted one on each side of a continuous mining machine. The twelve spray nozzles mounted under the boom are arranged with a set of six nozzles being mounted on the left half of the boom with spray nozzles generally angled to the right, as shown in FIG. 2, and the other set of six nozzles being mounted on the right half of the boom with the spray nozzles generally angled to the left. This embodiment allows flexibility in being able to have the exhaust ventilation curtain on either rib side of the mine entry. For instance, when the exhaust ventilation curtain is on the left rib side, the set of six spray nozzles on the right half of the boom sprays water on the cutting drum while the left set of spray nozzle is inactive. Thus, only one set of six spray nozzles underneath the boom are spraying water on the drum at any one time.

While it is generally preferable to totally eliminate top mounted spray nozzles from the water spray ventilator system of the invention in order to improve face visibility, it may not be possible to totally omit the top spray manifold in certain applications. In these cases, the underboom manifold may be used in conjunction with a top spray manifold which has been designed for minimal water consumption to minimize the dust rollback phenomena.

The water spray ventilator system of the invention was shown in laboratory tests as well as in actual mining operations to be efficient in clearing dust from the working face with a concomitant improvement in face visibility. Tests also showed that this water spray system was effective in reducing dust levels at the cab position (40), regardless of machine position in the mine entry. In addition, tests have shown that the invention provides better clearing and less dust rollback than that created by face ventilation air in the absence of any water sprays. In contrast, other water spray systems previously have increased machine operator dust exposure above the basal dust level in the absence of water spray.

Test results all showed 95% average dust reduction at the cab position of the mining machine. There are two very likely reasons why the underboom manifold works so well in reducing dust levels. First, there is a large air velocity differential between the top of the entry and the floor. In fact, the air velocity near the floor area is so low as to be barely measurable. The top sprays enhance this differential and consequently make the rollback more severe. The underboom sprays tend to induce more airflow on the bottom of the entry and therefore tent to equalize the velocity distribution from top to bottom. More air velocity on the floor reduces or eliminates rollback. Second, the bottom sprays actually blow the dust up around the drum above the machine. Since this is where the majority of the air velocity is present, the air prevents rollback. Tests with smoke bombs provide a very striking display that this is in fact what is happening. Based upon tests in the end box, start box, and start slab positions with curtain setback of 19 ft and an MEV of 52 fpm, this system appears to be inherently better than any other system developed because the curtain and off-curtain side dust exposures are virtually eliminated for any position of the continuous mining machine. In other words, dust produced from cutting in an actual mine will not roll back on either side.

Because higher pressures and/or flowrates can be used without causing dust rollback, more fluid horsepower can be applied. In the slab cut, this means that the box is better ventilated due to the exposed underboom sprays. Also, the underboom area would be better ventilated from a methane gas standpoint and more water would be applied where the majority of the dust is located. Although this is intended for mines with marginal airflows (i.e. mines with no methane gas problems), such a system would also be an improvement over conventional systems and useful for gassy mines. With regard to methane gas reduction, tests showed that the water spray system of the invention lowered the average face methane concentration by 47% and cleared the entry of all methane 33% faster that conventional-type spray systems.

An added advantage with this water spray ventilator system is that when the water spray is applied underneath the boom where the cut coal is loaded out to a shuttle car, the coal will be more effectively wetted than with top mounted sprays. Consequently, the coal being loaded into the shuttle car generates less dust which further reduces the level of dust exposure for the machine operator in the cab of a continuous mining machine. As a secondary source of dust which is independent of any other sources or conditions that contribute to operator dust exposure, if the coal being loaded onto the shuttle car is not sufficiently wet, the operator will be exposed to coal dust generated by this operation.

Therefore, the water spray ventilator system of the invention is advantageous in significantly reducing this secondary dust source.

Furthermore, the Bureau of Mines' Fires and Explosions (F&E) Group has stated that whereas top spray manifolds provides no protection from frictional ignition, underboom sprays would appear to be more beneficial than top mounted sprays in reducing frictional ignition because the spray would cool the bits immediately as they exit the cut, combined with additional evaporative cooling during the non-cutting rotation of bits on the drum. Previously, the only system recommended by the F&E group for reducing frictional ignition is the water-through-the-drum water system. One cause of frictional ignition is wear (flat) spots on the cutting bits caused by the bit not rotating in the bit block. Unlike top mounted sprays, underboom sprays are directed at the front of the bit instead of behind the bit. This feature provides better bit lubrication, longer bit life, less wear spots, and therefore, reduces the chances of frictional ignition. Test results with the underboom water spray manifold of the invention indicated improved bit lubrication, an important factor in reducing frictional ignition.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A water spray ventilator system for continuous mining machines, comprising at least one manifold mountable on the underside of a boom of said continuous mining machine, said manifold having two ends, a plurality of nozzles disposed along the longitudinal axis of said manifold between said ends for spraying water, each of said nozzles having a longitudinal axis in a common plane, each of said nozzles forming a different angle with the longitudinal axis of said manifold, each said angle of said nozzles progressively increasing from one of said two ends of said manifold to another of said two ends.

2. A water spray ventilator system for continuous mining machines as recited in claim 1, further comprising a manifold track mounted on an underside of a boom on said continuous mining machine for securing said manifold to the boom, said manifold slidable engaged on said manifold track.

3. A water spray ventilator system for continuous mining machines as recited in claim 1, further comprising at least one side nozzle positioned on each side of said continuous mining machine.

4. A water spray ventilator system for continuous mining machines as recited in claim 1, further comprising a top manifold having a plurality of nozzles for spraying water.

5. A water spray ventilator system for continuous mining machines as recited in claim 1, wherein said plurality of nozzles is six.

6. A water spray ventilator system for continuous mining machines as recited in claim 5, wherein said manifold comprises two longitudinal sections, one of said longitudinal sections having between three and five of said plurality of nozzles and the other of said longitudinal sections having the remainder of said plurality of nozzles.

7. A water spray ventilator system for continuous mining machines as recited in claim 1, wherein said plurality of nozzles are disposed with a non-uniform spacing along the longitudinal axis of said manifold.

8. A water spray ventilator system for continuous mining machines as recited in claim 1, wherein said plurality of nozzles are non-uniform in size.

9. A water spray ventilator system for continuous mining machines as recited in claim 1, wherein said manifold has a discontinuous base for mounting on the underside of said boom of said continuous mining machine.

* * * * *